US008038421B2

(12) United States Patent
Kuwahara et al.

(10) Patent No.: US 8,038,421 B2
(45) Date of Patent: Oct. 18, 2011

(54) SCROLL COMPRESSOR HAVING AN ALLOWABLE ANGLE OF ROTATION

(75) Inventors: Takayuki Kuwahara, Aichi (JP); Tetsuzou Ukai, Aichi (JP); Katsuhiro Fujita, Aichi (JP); Kazuhide Watanabe, Aichi (JP); Tomohisa Moro, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 332 days.

(21) Appl. No.: 12/442,579

(22) PCT Filed: Feb. 4, 2008

(86) PCT No.: PCT/JP2008/051720

§ 371 (c)(1), (2), (4) Date: Mar. 24, 2009

(87) PCT Pub. No.: WO2008/105219

PCT Pub. Date: Sep. 4, 2008

(65) Prior Publication Data

US 2010/0021329 A1 Jan. 28, 2010

(30) Foreign Application Priority Data

Feb. 27, 2007 (JP) ..... 2007-047623

(51) Int. Cl.
*F03C 2/00* (2006.01)
*F03C 4/00* (2006.01)

(52) U.S. Cl. ..... 418/55.2; 418/55.1; 418/55.3; 418/181

(58) Field of Classification Search ..... 418/55.1–55.6, 418/57, 181, 150
See application file for complete search history.

(56) References Cited

U.S. PATENT DOCUMENTS 4,477,238 A * 10/1984 Terauchi ..... 418/55.5
4,490,099 A * 12/1984 Terauchi et al. ..... 418/55.2
5,516,267 A * 5/1996 Ikeda et al. ..... 418/14
5,542,829 A * 8/1996 Inagaki et al. ..... 418/55.3
(Continued)

FOREIGN PATENT DOCUMENTS

EP 0122068 A1 3/1984
(Continued)

OTHER PUBLICATIONS

International Search Report of PCT/JP2008/051720, Mailing Date of Apr. 8, 2008.

*Primary Examiner* — Theresa Trieu
(74) *Attorney, Agent, or Firm* — Westerman, Hattori, Daniels & Adrian, LLP

(57) ABSTRACT

A scroll compressor includes a fixed scroll and an orbiting scroll, each including a spiral wrap protruding from an end plate and having the same tooth thickness (Tr) and the same base-circle radius (b) defining an involute surface. The fixed scroll and the orbiting scroll are offset from each other by an orbiting radius (ρ) and mesh such that the respective wraps face each other with a phase shift of 180°. The orbiting scroll revolves/orbits along a circular orbit with the orbiting radius (ρ) to compress a gas while a rotation-preventing mechanism prevents rotation of the orbiting scroll. The relationship between the involute surfaces of the spiral wraps of the two scrolls and the dimensions, dimensional tolerance, and assembly standards of the rotation-preventing mechanism are determined so that the median value of an allowable angle of rotation (ϕ) agrees with an upright position of the orbiting scroll.

5 Claims, 8 Drawing Sheets

U.S. PATENT DOCUMENTS

| | | | | |
|---|---|---|---|---|
| 6,331,102 | B1 * | 12/2001 | Takeuchi et al. | 418/55.3 |
| 7,217,109 | B2 * | 5/2007 | Takei | 418/55.3 |
| 2007/0217934 | A1 * | 9/2007 | Tateishi et al. | 418/55.2 |
| 2007/0292293 | A1 * | 12/2007 | Fujita et al. | 418/55.2 |

FOREIGN PATENT DOCUMENTS

| | | | |
|---|---|---|---|
| JP | 59-168289 | A | 9/1984 |
| JP | 62-17383 | A | 1/1987 |
| JP | 5-71477 | A | 3/1993 |
| JP | 08-049672 | A | 2/1996 |
| JP | 9-195955 | A | 7/1997 |
| JP | 2000-230487 | A | 8/2000 |
| JP | 2002-180976 | A | 6/2002 |

* cited by examiner

SCROLL COMPRESSOR HAVING AN ALLOWABLE ANGLE OF ROTATION

TECHNICAL FIELD

The present invention relates to scroll compressors for use in, for example, air conditioners and refrigerators.

BACKGROUND ART

In assembling a fixed scroll and an orbiting scroll of a conventional scroll compressor, a buildup of dimensional errors and shape errors, for example, of related components responsible for positioning of the two scrolls causes a margin within which the phase shift angle between the two scrolls twists clockwise and counterclockwise from a reference value of 180° during operation. That is, an orbiting scroll of a scroll compressor is known to be twisted in position from the upright position thereof about the center of an end plate during operation, depending on factors such as the specifications and dimensional tolerance of a rotation-preventing mechanism. In the description below, the twist from the upright position is referred to as an "amount of twist in position α", and the twisting margin depending on, for example, the specifications and dimensional tolerance of a rotation-preventing mechanism is referred to as an "allowable angle of rotation (ϕ)".

It is difficult to readily reduce the allowable angle of rotation ϕ because it depends on, for example, the rotation-preventing function and the machining accuracy. The upright position of an orbiting scroll is the position where an involute surface of a spiral wrap of the orbiting scroll has a phase shift of 180° from an involute surface of a spiral wrap of a fixed scroll.

Disclosed in the conventional art relating to the allowable angle of rotation ϕ described above as a measure against noise due to the allowable angle of rotation ϕ and the amount of twist in position α, resulting from gas pressure, is a scroll compressor in which an inner involute surface of a fixed spiral wrap of a fixed scroll is cut to a predetermined depth Δtr to reduce its tooth thickness to Tr−Δtr so that the assembly reference positions of the fixed scroll and the orbiting scroll are substantially twisted from their normal assembly reference positions (positions where the two scrolls have a phase shift of 180°) in a direction opposite an orbiting direction by an appropriate angle (for example, see Patent Document 1).

For a scroll compressor including stepped scrolls to avoid compression leakage during operation, thereby ensuring high compression efficiency, it has been proposed to bring a step of either a spiral or a spiral groove of the orbiting scroll or the fixed scroll farther away from a corresponding step in a rotation direction of the orbiting scroll while bringing the other step closer to a corresponding step in the direction opposite the rotation direction, thus forming asymmetrical shapes (for example, see Patent Document 2).

Patent Document 1: Japanese Unexamined Patent Application, Publication No. HEI-8-49672

Patent Document 2: Japanese Unexamined Patent Application, Publication No. HEI-5-71477

DISCLOSURE OF INVENTION

If the twist in position α described above occurs, the orbiting radius ρ of the orbiting scroll decreases with increasing amount of twist in position α, as shown in, for example, FIG. 8.

This will be specifically described with reference to FIG. 3, focusing on contact points of two scrolls 2 and 3. If the twist in position α occurs in such a direction that an inner involute surface 2*a*' of a fixed spiral wrap jams (bites) at a contact point A, in other words, if the twist in position α occurs in such a direction that an outer involute surface 2*a*" of the fixed spiral wrap is separated from a contact point B, the inner involute surface 2*a*' of the fixed spiral wrap does not actually jam (bite) at the contact point A; rather, the orbiting radius ρ of the orbiting scroll, which revolves/orbits while being prevented from rotating relative to the fixed scroll, is decreased in response to the amount of twist in position α (amount of jamming−mesh gap Sa). Accordingly, a wider mesh gap (face-to-face gap between the spiral wraps) is formed at the contact point B of the outer involute surface 2*a*" of the fixed spiral wrap.

The mesh gap Sa is a theoretical gap formed between the surfaces of the spiral wraps of the fixed scroll 2 and the orbiting scroll 3 if the amount of twist in position α occurs between the fixed scroll 2 and the orbiting scroll 3 due to the allowable angle of rotation ϕ.

This results in an increase in the leakage of the gas being compressed by the scroll compressor from a higher-pressure compression chamber into a lower-pressure compression chamber. Such increased leakage is undesirable because it decreases the performance of the scroll compressor.

An object of the present invention, which has been made under the above circumstances, is to provide a scroll compressor that does not involve a decrease in compression performance or an increase in noise due to leakage resulting from the allowable angle of rotation ϕ.

To achieve the above object, the present invention employs the following solutions.

A scroll compressor according to an aspect of the present invention includes a fixed scroll and an orbiting scroll, each including a spiral wrap protruding from an end plate and having a tooth thickness Tr and the same base-circle radius b defining an involute surface. The fixed scroll and the orbiting scroll are offset from each other by an orbiting radius ρ and mesh such that the respective wraps face each other with a phase shift of 180°. The orbiting scroll revolves/orbits along a circular orbit with the orbiting radius ρ to compress a gas while a rotation-preventing mechanism prevents rotation of the orbiting scroll. The relationship between the involute surfaces of the spiral wraps of the two scrolls and the dimensions and dimensional tolerance of the rotation-preventing mechanism are determined so that the median value of an allowable angle of rotation ϕ agrees with an upright position of the orbiting scroll. That is, the median value is adjusted without changing the allowable angle of rotation ϕ.

According to the above aspect of the present invention, because the median value of the allowable angle of rotation ϕagrees with the upright position of the orbiting scroll, the amount of twist in position α by which the orbiting scroll is twisted from the upright position to the left or right can be reduced to half the allowable angle of rotation ($\alpha=\pm\frac{1}{2}\phi$).

In the above scroll compressor, preferably, the median value of the allowable angle of rotation ϕ is shifted from the upright position of the orbiting scroll in a direction (left) opposite an orbiting direction. This reduces the amount of twist in position α in the case where a twisting moment acts in the orbiting direction (right direction) under normal operation.

In the above scroll compressor, preferably, the fixed scroll and the orbiting scroll have stepped shapes, and a gap corresponding to the amount of twist in position α is defined between meshing portions of the stepped shapes. This prevents a decrease in orbiting radius ρ due to the meshing portions of the stepped shapes.

In this case, preferably, the gap defined between the meshing portions of the stepped shapes measures 10 to 100 μm.

According to the present invention, as described above, the median value of the allowable angle of rotation ϕ agrees with the upright position of the orbiting scroll, so that mesh gaps formed between the two scrolls due to the amount of twist in position α can be narrowed. This reduces the leakage of gas from a higher-pressure compression chamber into a lower-pressure compression chamber, thus improving the compression performance of the scroll compressor.

In addition, the gap corresponding to the amount of twist in position α can be defined between the meshing portions of the stepped shapes to prevent the decrease in orbiting radius ρ due to the meshing portions of the stepped shapes. This reduces the leakage of gas from the higher-pressure compression chamber into the lower-pressure compression chamber, thus improving the compression performance of the scroll compressor.

EXPLANATION OF REFERENCE SIGNS

Figure 1:
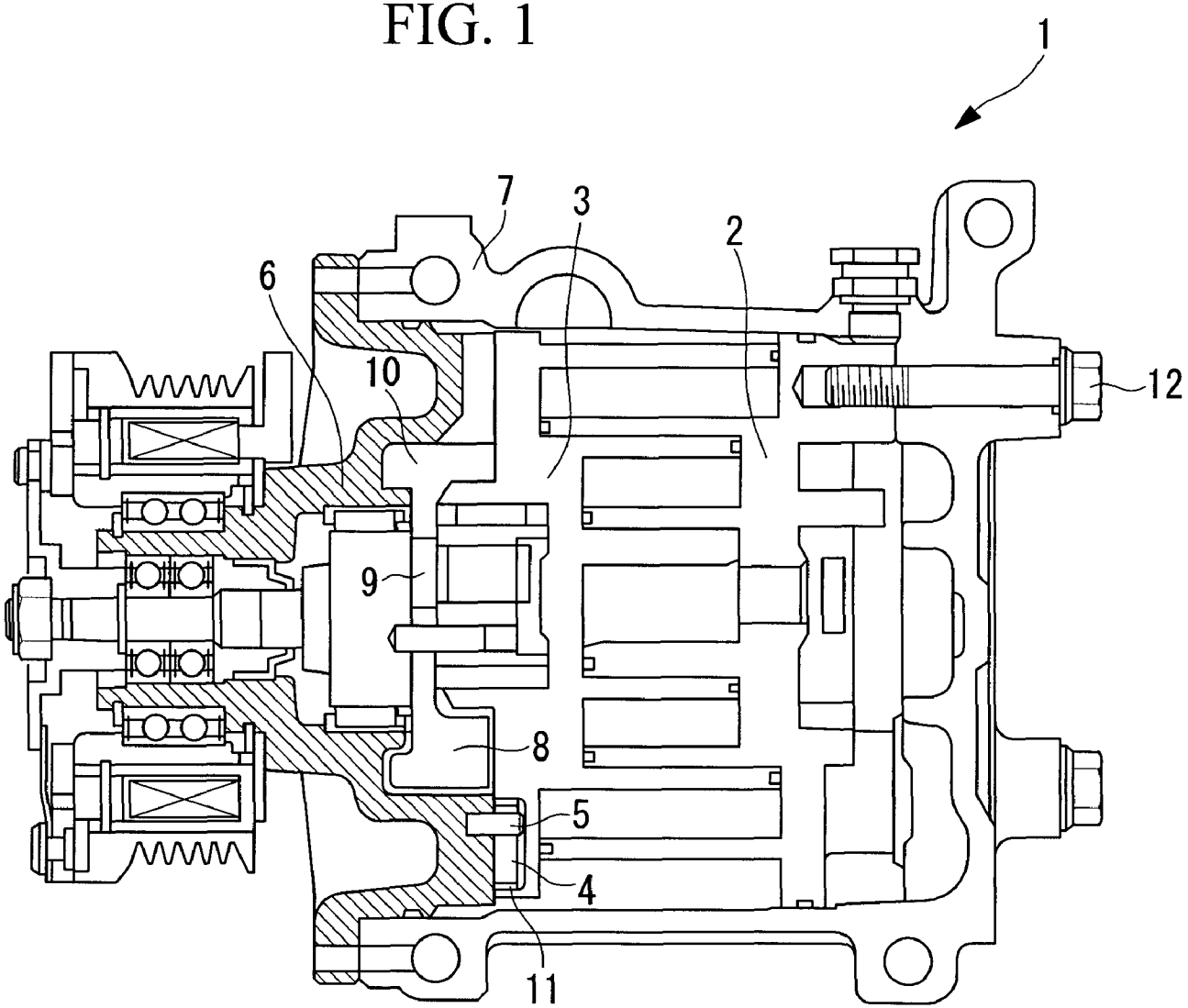
FIG. 1 is a sectional view showing an exemplary structure of a scroll compressor according to the present invention.

1: scroll compressor
2: fixed scroll
3: orbiting scroll
4: ring hole
5: pin
11: ring
ρ, $\rho_{pin}$: orbiting radius
$\rho_{th}$: theoretical orbiting radius
ϕ: allowable angle of rotation
α: amount of twist in position (amount of twist with respect to upright position of orbiting scroll)

BEST MODE FOR CARRYING OUT THE INVENTION

An embodiment of a scroll compressor according to the present invention will now be described with reference to the drawings.

FIG. 1 is a sectional view of an exemplary structure of a horizontal scroll compressor. This scroll compressor 1 includes a fixed scroll 2 fixed to a housing 7 with bolts 12 and an orbiting scroll 3 that revolves/orbits without rotating relative to the fixed scroll 2 to compress, for example, a refrigerant gas.

A front case 6 is fixed to the housing 7 on the rear side of the orbiting scroll 3 (on the left in FIG. 1). The front case 6 is configured to receive a thrust force from the orbiting scroll 3 and has a plurality of pins 5 (four at intervals of 90° in the circumferential direction in this embodiment) disposed on its inner end surface (i.e., a substantially annular surface in contact with a rear end surface of the orbiting scroll 3).

Rings 11 press-fitted or loosely fitted in ring holes 4 are disposed in the rear (outer) end surface of the orbiting scroll 3 (the surface in contact with the inner end surface of the front case 6) so as to accommodate the corresponding pins 5. The number of the pins 5 equals that of the ring holes 4 (four in this embodiment), and protruding portions of the pins 5 are loosely inserted in the rings 11. A crank chamber 10 is provided in the center of the inner side of the front case 6 so as to accommodate an eccentric shaft 9 and a balance weight 8.

The orbiting scroll 3 engages with the front case 6 with the pins 5 loosely inserted in the rings 11. The ring holes 4, the rings 11, and the pins 5 constitute a rotation-preventing mechanism that operates to prevent the orbiting scroll 3 from rotating while being made to revolve/orbit by the eccentric shaft 9. The pins 5 revolve along the inner circumferential surfaces of the rings 11 in the same direction as the orbiting scroll 3. The rotation-preventing mechanism used is not limited to the above pin-and-ring mechanism, but may also be, for example, an Oldham ring mechanism.

Figure 3:
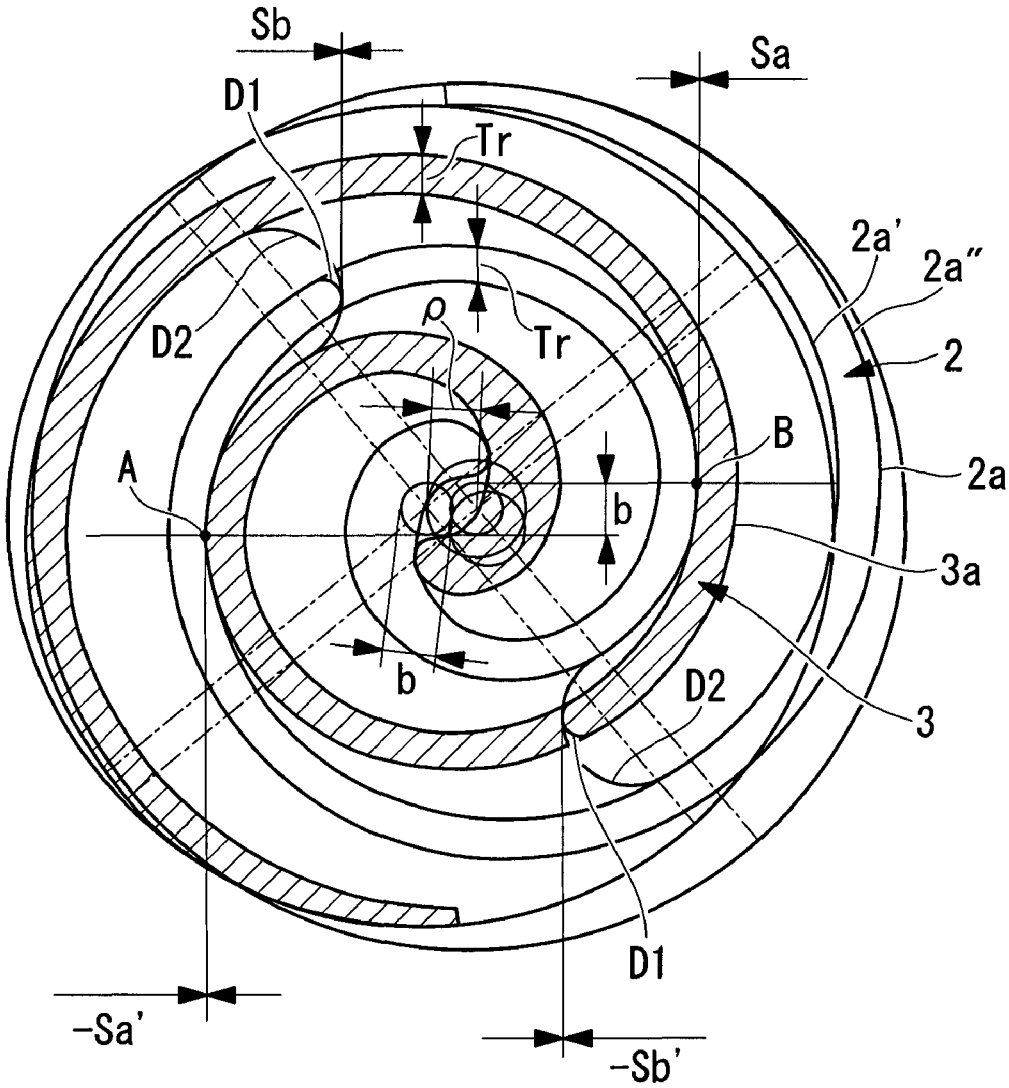
FIG. 3 is a diagram showing a fixed scroll and an orbiting scroll having stepped shapes.

Referring to FIG. 3, for example, the fixed scroll 2 and the orbiting scroll 3 include spiral wraps 2*a* and 3*a*, respectively, protruding from their end plates and having the same tooth thickness Tr and the same base-circle radius b defining their involute surfaces. In the scroll compressor 1, the fixed scroll 2 and the orbiting scroll 3 are offset from each other by an orbiting radius ρ and mesh such that the respective wraps 2*a* and 3*a* face each other with a phase shift of 180°. The orbiting scroll 3 of the scroll compressor 1 revolves/orbits along a circular orbit with the orbiting radius ρ to compress the gas while the above rotation-preventing mechanism prevents rotation of the orbiting scroll 3.

The orbiting radius ρ corresponds to a path drawn based on the distance between the base circles of the fixed scroll 2 and the orbiting scroll 3.

Figure 2A:
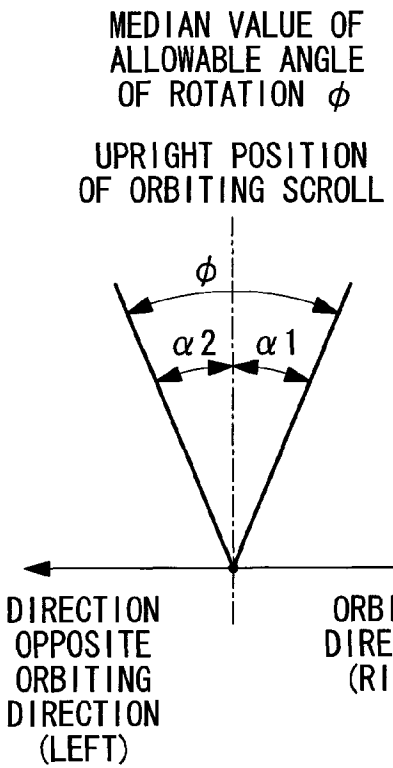
FIG. 2A is a diagram showing the relationship between the allowable angle of rotation ϕ and the amount of twist in position α of an orbiting scroll, where the median value of the allowable angle of rotation ϕ agrees with an upright position of the orbiting scroll.

For the scroll compressor 1 thus configured, in the present invention, the relationship between the involute surfaces of the spiral wraps of the two scrolls and the dimensions and dimensional tolerance of the rotation-preventing mechanism are determined so that the median value of an allowable angle of rotation ϕ agrees with the upright position of the orbiting scroll (FIG. 2A).

If an amount of twist in position α occurs between the fixed scroll 2 and the orbiting scroll 3 due to the allowable angle of rotation ϕ, mesh gaps Sa and −Sa' are theoretically formed between the surfaces of the spiral wraps of the fixed scroll 2 and the orbiting scroll 3 at points of contact with the inner involute surface 2*a*' of the fixed spiral wrap and the outer involute surface 2*a*" of the fixed spiral wrap, respectively. For the scroll compressor 1, generally, the mesh gaps Sa and −Sa' measure about 5 μm. At a position twisted in the orbiting direction (right), the gap Sa at the point of contact with the outer involute surface 2*a*" of the fixed spiral wrap has a positive value, while the other gap −Sa' (at the point of contact with the inner involute surface 2*a*' of the fixed spiral wrap) has a negative value. Their signs are inverted at a position twisted in the direction (left) opposite the orbiting direction. The positive value means that a mesh gap is formed, whereas the negative value means that the spiral wraps jam against (bite into) each other.

If the scroll compressor 1 is kept operating in that state, when twisted to the right, a negative gap −Sa' occurs; that is, the spiral wraps press against and tightly contact each other. In such a state, the absolute value Sa' of the gap −Sa' is added to the gap Sa because the orbiting radius ρ is decreased. Hence, the initial gap Sa is widened by the absolute value Sa' of the gap −Sa', thus forming a maximum gap S (S=Sa+Sa') at the point of contact with the outer involute surface 2*a*" of the fixed spiral wrap.

The gap −Sa' described above, however, is halved together with the gap Sa if the relationship between the involute surfaces of the spiral wraps of the two scrolls and the dimensions and dimensional tolerance of the rotation-preventing mechanism are determined so that the median value of the allowable angle of rotation ϕ agrees with the upright position of the orbiting scroll. As the gap Sa and the absolute value Sa', to be added to the gap Sa, of the gap −Sa' are halved, the maximum gap S is halved, thus becoming smaller.

Narrowing the maximum gap S reduces the leakage of gas from a higher-pressure compression chamber into a lower-pressure compression chamber during the operation of the scroll compressor 1, thus improving the compression performance of the scroll compressor 1.

Figure 4A:
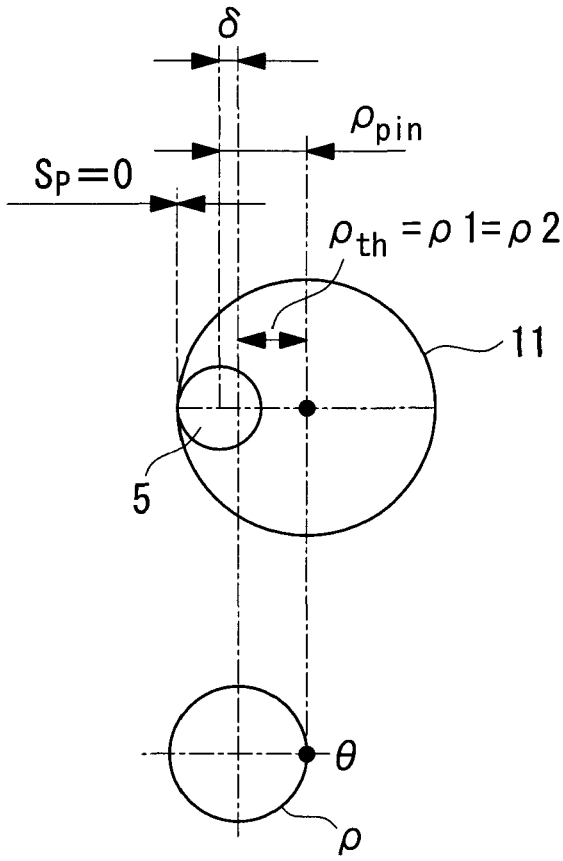
FIG. 4A is a diagram showing the relationship between a pin-and-ring mechanism and an orbiting radius at a pin location angle θ, illustrating a phenomenon in which the orbiting radius ρ decreases due to a pin offset of the pin-and-ring mechanism.
Figure 4B:
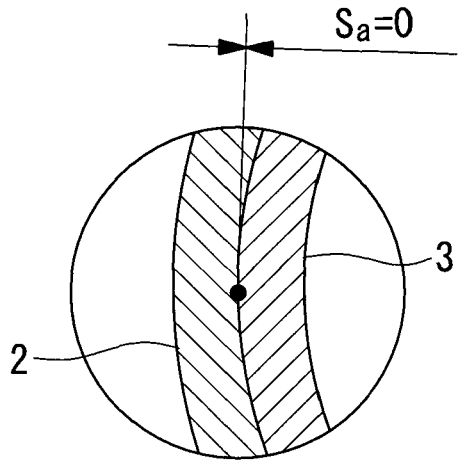
FIG. 4B is an enlarged view of a mesh gap, illustrating the phenomenon in which the orbiting radius ρ decreases due to the pin offset of the pin-and-ring mechanism.

Referring to FIG. 4A, the pins 5 of the pin-and-ring rotation-preventing mechanism shown in this embodiment have an offset δ to prevent the spiral wraps (tooth surfaces) of the fixed scroll 2 and the orbiting scroll 3 from failing to mesh with each other. Providing the offset δ makes the allowable angle of rotation ϕ relatively large, and the compression performance of the scroll compressor 1 is decreased due to a leakage from the gap Sa as a result of the amount of twist in position α.

Specifically, the offset δ is set on the basis of dimensional tolerance, such as assembly error, so that an orbiting radius $\rho_{pin}$ determined by the rings 11 and the pins 5 can exceed a theoretical orbiting radius $\rho_{th}$ (ρ1) determined by the scrolls (i.e., determined by the mesh between the tooth surfaces of the fixed scroll 2 and the orbiting scroll 3) during the orbiting of the orbiting scroll 3. In the state shown (pin location angle θ), the scroll orbiting radius ρ is ρ1, and the pin-and-ring orbiting radius ρ2 equals the scroll orbiting radius ρ1 ($\rho_{th}$=ρ1=ρ2). The orbiting radius $\rho_{pin}$ is the sum of the pin-and-ring orbiting radius ρ2 and the offset δ ($\rho_{pin}$=ρ2+δ). In this state, which is the upright state of the orbiting scroll, the outer circumferential surfaces of the pins 5 contact the inner circumferential surfaces of the rings 11, and no gap Sp is formed therebetween (Sp=0). In addition, no mesh gap Sa is formed (Sa=0).

Figure 6A:
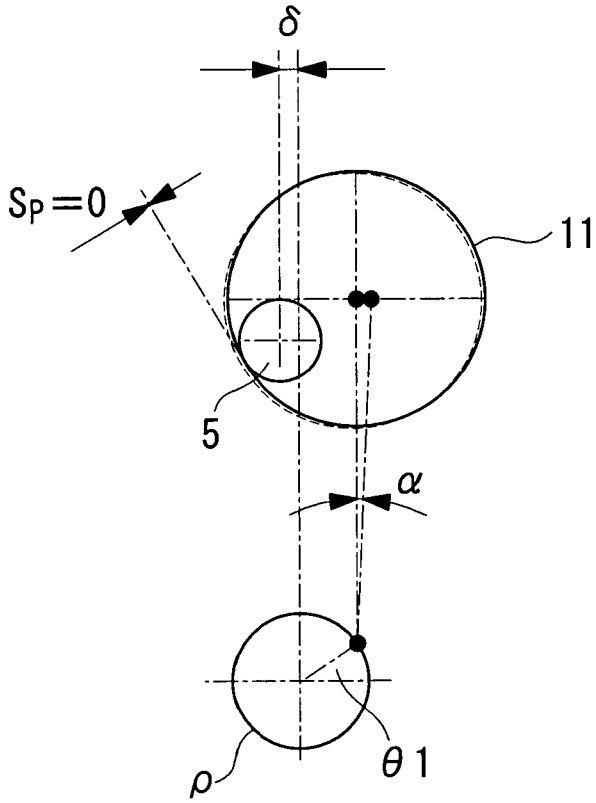
FIG. 6A is a diagram showing the relationship between the pin-and-ring mechanism and the orbiting radius in the state where the twist in position α has occurred at the orbiting angle θ1, illustrating the phenomenon in which the orbiting radius ρ decreases due to the pin offset of the pin-and-ring mechanism.
Figure 6B:
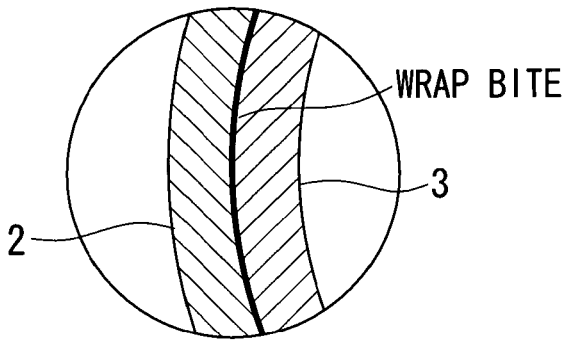
FIG. 6B is an enlarged view of the mesh gap, illustrating the phenomenon in which the orbiting radius ρ decreases due to the pin offset of the pin-and-ring mechanism.
Figure 7A:
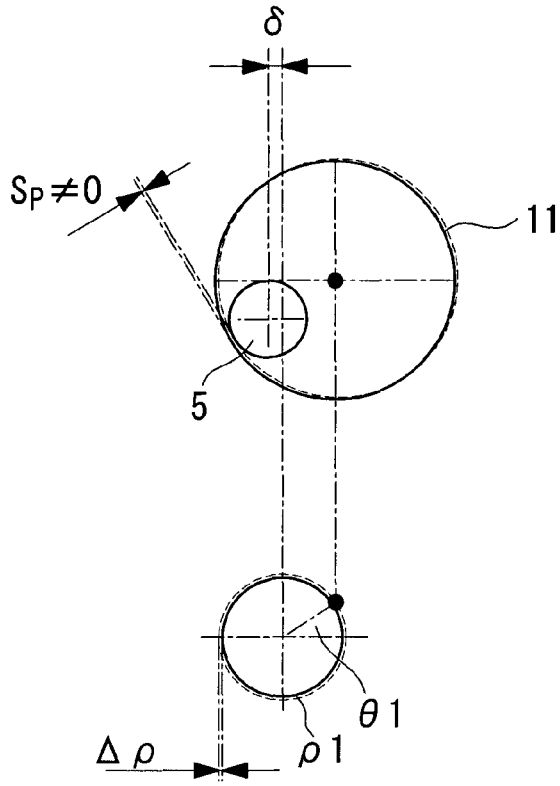
FIG. 7A is a diagram showing the relationship between the pin-and-ring mechanism and the orbiting radius in the state where the orbiting radius ρ has decreased at the orbiting angle θ1, illustrating the phenomenon in which the orbiting radius ρ decreases due to the pin offset of the pin-and-ring mechanism.
Figure 7B:
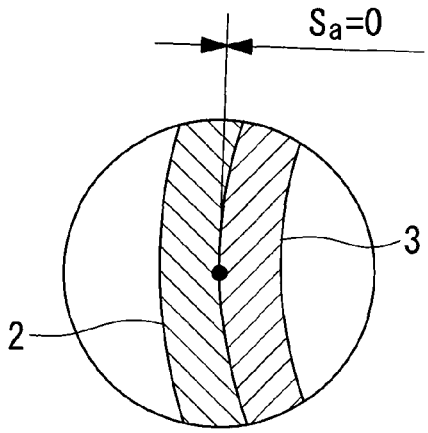
FIG. 7B is an enlarged view of the mesh gap, illustrating the phenomenon in which the orbiting radius ρ decreases due to the pin offset of the pin-and-ring mechanism.
Figure 8:
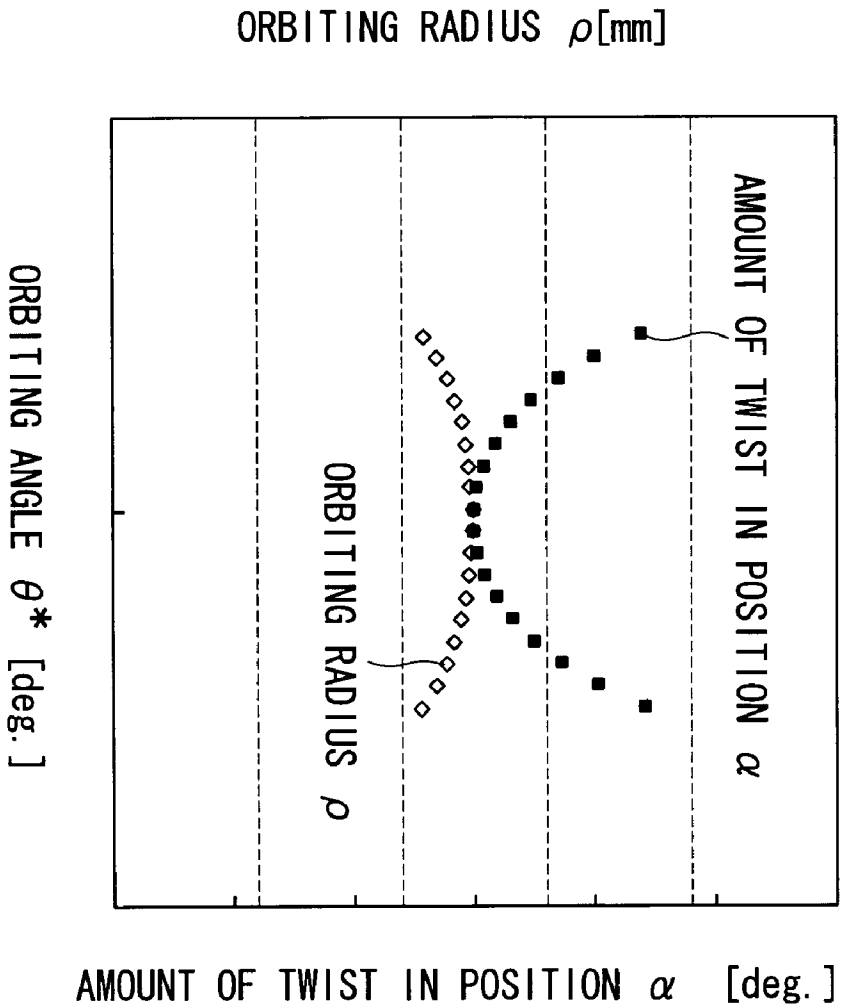
FIG. 8 is a graph showing the relationship between the amount of twist in position α and the orbiting radius ρ relative to the orbiting angle.

With a shift from the state in FIG. 4A (pin location angle θ) to an orbiting angle θ1 (see FIG. 5A), $\rho_{th}$=ρ1≠ρ2 under the effect of the offset δ. Because Sp≠0, the gap Sp is formed between the outer circumferential surfaces of the pins 5 and the inner circumferential surfaces of the rings 11. As the solid line of FIG. 6A indicates, the orbiting scroll 3 rotates in the orbiting direction (right direction) by the gap Sp, thus experiencing the amount of twist in position α. In this state, the gap Sp disappears (Sp=0), and the mesh gap Sa changes from zero to the state where the wraps jam against (bite into) each other (see FIG. 6B). Hence, the scroll orbiting radius ρ1, shown by the broken line of FIG. 7A, is decreased by Δρ to a smaller orbiting radius (shown by the solid line).

Figure 5A:
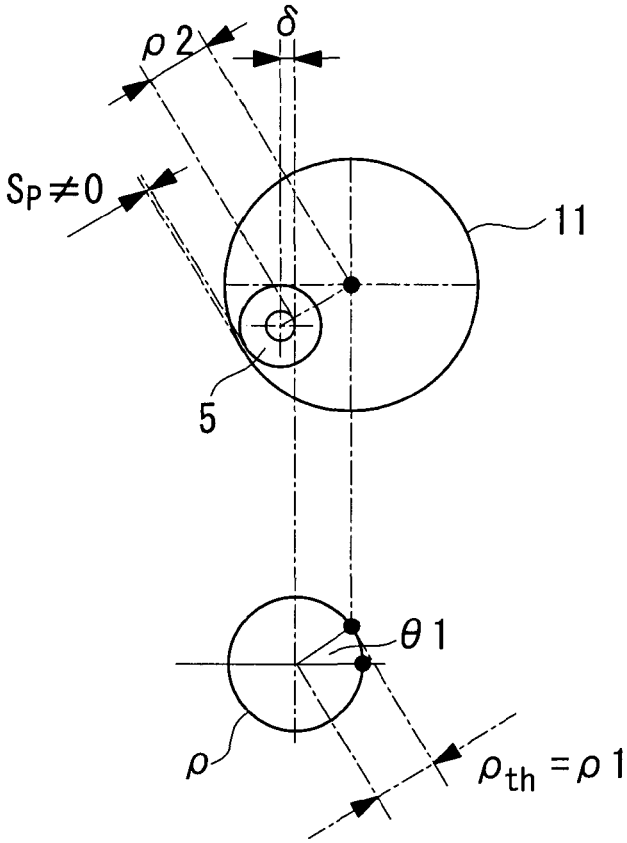
FIG. 5A is a diagram showing the relationship between the pin-and-ring mechanism and the orbiting radius at an orbiting angle θ1, illustrating the phenomenon in which the orbiting radius ρ decreases due to the pin offset of the pin-and-ring mechanism.
Figure 5B:
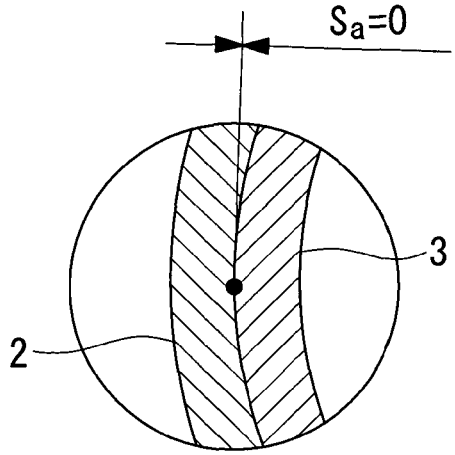
FIG. 5B is an enlarged view of the mesh gap, illustrating the phenomenon in which the orbiting radius ρ decreases due to the pin offset of the pin-and-ring mechanism.

As the orbiting radius is decreased, the gap Sp is formed again, as shown in FIG. 5A. As a result, the change in state from FIG. 5A to FIG. 7A is repeated until the orbiting radius ρ1 decreases to a certain value.

Such a decrease in orbiting radius ρ1 widens the mesh gap and therefore increases the leakage of gas during the operation of the scroll compressor 1, thus leading to decreased performance. However, as described above, the amount of twist in position α can be reduced to minimize the decrease in orbiting radius ρ1 if the relationship between the involute surfaces of the spiral wraps of the two scrolls and the dimensions and dimensional tolerance of the pins 5 and the rings 11, which constitute the rotation-preventing mechanism, are determined so that the median value of the allowable angle of rotation ϕ agrees with the upright position of the orbiting scroll. Hence, it is possible to minimize the widening of the mesh gap and therefore to reduce the leakage of gas from the higher-pressure compression chamber into the lower-pressure compression chamber during the operation of the scroll compressor 1, thus improving the compression performance of the scroll compressor 1.

In the above embodiment, the dimensional tolerance of the rotation-preventing mechanism is determined so that the median value of the allowable angle of rotation ϕ agrees with the upright position of the orbiting scroll; alternatively, the median value of the allowable angle of rotation ϕ may be set to a value shifted to the left from the upright position of the orbiting scroll to reduce the amount of twist in position α in the case where a twisting moment acts in the right direction. That is, the median value of the allowable angle of rotation ϕ may be slightly shifted in the left direction by slightly tilting the allowable angle of rotation ϕ from the state of FIG. 2A to that of FIG. 2B to adapt to a twisting moment towards the right.

Figure 2B:
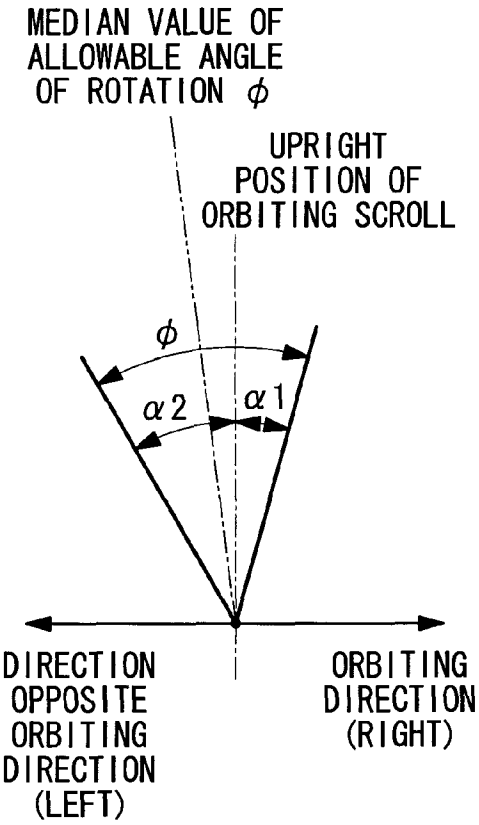
FIG. 2B is a diagram showing the relationship between the allowable angle of rotation ϕ and the amount of twist in position α of the orbiting scroll, where the median value of the allowable angle of rotation ϕ is shifted to the left from the upright position of the orbiting scroll.

In normal operation of the scroll compressor 1, a twisting moment acts on the orbiting scroll 3 in the orbiting direction (right direction). As shown in FIG. 2B, therefore, the median value of the allowable angle of rotation $\phi$ may be shifted from the upright position of the orbiting scroll in the direction opposite the orbiting direction (left direction).

Figure 2C:
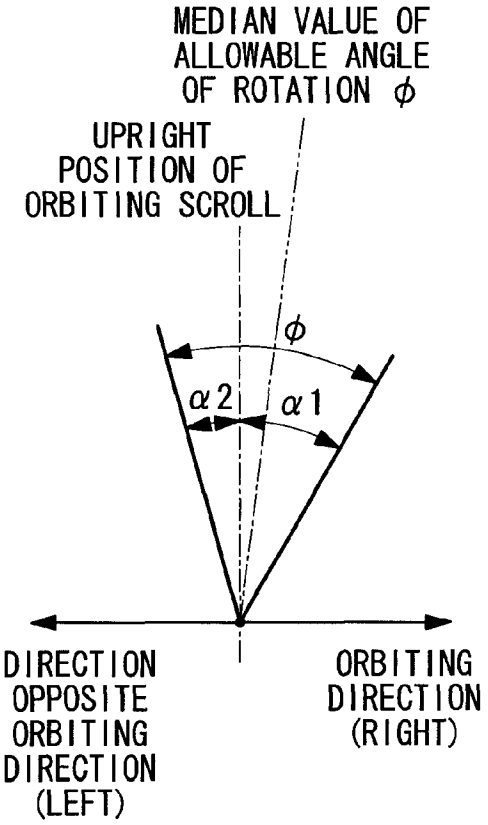
FIG. 2C is a diagram showing the relationship between the allowable angle of rotation ϕ and the amount of twist in position α of the orbiting scroll, where the median value of the allowable angle of rotation ϕ is shifted to the right from the upright position of the orbiting scroll.

Conversely, as the number of revolutions of the orbiting scroll 3 is increased to a high-speed revolution region, it can experience a twisting moment, resulting from the significant effect of a centrifugal moment due to its own weight, in the direction (left direction) opposite the orbiting direction. To adapt to the centrifugal moment, it is desirable to set up the compressor so that the median value of the allowable angle of rotation $\phi$ is shifted to the orbiting direction (right direction), as shown in FIG. 2C. To cover a wide range from the low-speed revolution region to the high-speed revolution region of the orbiting scroll 3, however, it is the most desirable to set up the compressor so that the median value of the allowable angle of rotation $\phi$ agrees with the upright position of the orbiting scroll. To give priority to the revolution region and its vicinity where the maximum efficiency is reached, it is also possible to set up the compressor so that the median value of the allowable angle of rotation $\phi$ is slightly shifted from the upright position of the orbiting scroll in the direction opposite the orbiting direction (left direction).

In addition, the fixed scroll 2 and the orbiting scroll 3 of the scroll compressor 1 shown in FIG. 1 have stepped shapes. These stepped shapes are formed such that the heights of the wraps and the end plates vary between the centers and the outer ends thereof along the spirals of the spirals shapes. That is, the wraps of the fixed scroll 2 and the orbiting scroll 3 have steps D1 where the wall heights vary between the centers, where the heights are lower, and the outer ends, where the heights are higher. Also, the end plates of the fixed scroll 2 and the orbiting scroll 3 have steps D2, corresponding to the steps D1 of the wraps, where the heights of the bottom surfaces vary between the centers, where the heights are higher, and the outer ends, where the heights are lower.

The above stepped shapes include meshing portions formed so that the steps D1 of the wrap teeth mesh with the steps D2 of the end plates during the orbiting of the orbiting scroll 3, and a gap corresponding to the amount of twist in position $\alpha$ described above is defined between the meshing portions.

That is, face-to-face gaps Sb and −Sb' corresponding to the amount of twist in position $\alpha$ are theoretically formed between the meshing portions of the steps D1 and D2. The face-to-face gaps Sb and −Sb' measure about several tens of micrometers, namely, about ten times the size of the mesh gaps Sa and −Sa'.

Of the face-to-face gaps Sb and −Sb', a negative face-to-face gap −Sb' means that the surfaces of the meshing portions jam against (bite into) each other; actually, the surfaces where the steps D1 and D2 are formed tightly contact each other without any gap therebetween. This results in a decrease in the orbiting radius $\rho$ of the orbiting scroll 3. Hence, as described above, the widening of the gap Sp, the increase in the amount of twist in position $\alpha$, the increase in the absolute value Sb' of the amount of jamming (bite), and the decrease in orbiting radius $\rho$ are repeated until the orbiting radius $\rho$ decreases to a certain value.

The gap (and jam) thus formed between the meshing portions of the steps D1 and D2 is undesirable because it decreases the compression efficiency of the scroll compressor 1 and causes noise.

For the jamming (negative) face-to-face gap −Sb' described above, a gap of a size Sb', which corresponds to the size of the face-to-face gap (jam), is defined in advance between the meshing portions in the upright position. As a result, when the orbiting scroll 3 experiences the amount of twist in position $\alpha$ during operation, the gap of the size Sb' defined in advance cancels out the negative face-to-face gap −Sb', which causes jamming, to substantially zero. This prevents the repetitive decrease in orbiting radius $\rho$ due to Sb' and the widening of the face-to-face gap Sb, positioned with a phase shift of 180°, due to the addition of the absolute value Sb'. Hence, it is possible to minimize the gaps formed between the meshing portions of the steps D1 and D2 and the mesh gaps and therefore to reduce the leakage of gas from these gaps.

That is, the gap corresponding to the amount of twist in position $\alpha$ can be defined between the meshing portions of the stepped shapes to prevent the decrease in orbiting radius $\rho$ due to the meshing portions of the stepped shapes. This reduces the leakage of gas to improve the compression performance of the scroll compressor 1.

The size of the gap defined between the meshing portions of the stepped shapes is preferably a maximum of 200 μm or less, more preferably 10 to 100 μm, if the pin offset $\delta$ of the pin-and-ring rotation-preventing mechanism is 0 to 0.2 mm (for a known example relating to offset, see Japanese Unexamined Patent Application, Publication No. 2000-230487) and the amount of twist in position $\alpha$ in the orbiting direction is 0° to 0.3°. As described above, if the allowable angle of rotation $\phi$ lies only in the orbiting direction, the size of the gap defined between the meshing portions of the stepped shapes in the direction opposite the orbiting direction may be 0 mm or more. If the pin offset $\delta$ is 0.1 to 0.2 mm, the orbiting radius $\rho$ is 2 to 6 mm, the rotation-preventing pin location (radius) $R_{pin}$ is 19 to 55 mm, and the base-circle radius b is 1.9 to 3.5 mm according to, for example, the mountability (body size) of the compressor and the capability of machining components (tolerance), the allowable angle of rotation $\phi$ (=amount of twist in position $\alpha$) is 0.0360 to 0.273° and the location of the steps (distance from the centers of the end plates) is about 33 to 47 mm, so that the gap size $\Delta s$ is determined to be 20 to 200 mm. In addition, As is determined to be 10 to 100 μm if the amount of twist in position $\alpha$ is $\frac{1}{2}\phi$.

According to the present invention, as described above, the relationship between the involute surfaces of the spiral wraps of the two scrolls and the dimensions and dimensional tolerance of the rotation-preventing mechanism are determined so that the median value of the allowable angle of rotation $\phi$agrees with the upright position of the orbiting scroll. This narrows the mesh gaps formed between the wraps of the fixed scroll 2 and the orbiting scroll 3 to half the size, thus reducing the leakage of gas from the higher-pressure compression chamber into the lower-pressure compression chamber, and improving the compression performance of the scroll compressor 1.

In addition, the gap corresponding to the amount of twist in position $\alpha$ can be defined between the meshing portions of the stepped shapes to prevent the decrease in orbiting radius $\rho$ due to the meshing portions of the stepped shapes. This reduces the leakage of gas from the meshing portions of the steps, thus improving the compression performance of the scroll compressor 1, as in the case of the mesh gaps. Also, the contact pressure of the steps is reduced, thus contributing to noise reduction.

The present invention is not limited to the above embodiment; modifications are permitted without departing from the spirit of the invention.

The invention claimed is:

1. A scroll compressor comprising a fixed scroll and an orbiting scroll, each including a spiral wrap protruding from an end plate and having a tooth thickness Tr and the same base-circle radius b defining an involute surface, the fixed scroll and the orbiting scroll being offset from each other by an orbiting radius ρ and meshing such that the respective wraps face each other with a phase shift of 180°, wherein the orbiting scroll revolves/orbits along a circular orbit with the orbiting radius ρ to compress a gas while a rotation-preventing mechanism prevents rotation of the orbiting scroll;

wherein a relationship between the involute surfaces of the spiral wraps of the two scrolls and the dimensions, dimensional tolerance, and assembly standards of the rotation-preventing mechanism are determined so that a median value of an allowable angle of rotation ϕ agrees with an upright position of the orbiting scroll.

2. The scroll compressor according to claim 1, wherein the fixed scroll and the orbiting scroll have stepped shapes, and a gap corresponding to an amount of twist α with respect to the upright position of the orbiting scroll is defined between meshing portions of the stepped shapes.

3. The scroll compressor according to claim 2, wherein the gap defined between the meshing portions of the stepped shapes measures 10 to 100 μm.

4. The scroll compressor according to claim 1, wherein the fixed scroll and the orbiting scroll have stepped shapes, and a gap corresponding to an amount of twist α with respect to the upright position of the orbiting scroll is defined between meshing portions of the stepped shapes.

5. The scroll compressor according to claim 4, wherein the gap defined between the meshing portions of the stepped shapes measures 10 to 100 μm.

* * * * *